US005556109A

United States Patent [19]

Trauner et al.

[11] Patent Number: 5,556,109

[45] Date of Patent: Sep. 17, 1996

[54] METHOD OF SEALING AND SEAL FOR A STARTER BAR HEAD TO BE USED IN A CONTINUOUS CASTER

[75] Inventors: Alfred Trauner, Perg; Gernot Lettmayr, St. Florian, both of Austria

[73] Assignee: Voest-Alpine Industrieanlagenbau GmbH, Austria

[21] Appl. No.: 219,649

[22] Filed: Mar. 29, 1994

[30] Foreign Application Priority Data

Mar. 30, 1993 [AT] Austria ..... 644/93

[51] Int. Cl.[6] ..... F16J 15/16; B22D 11/08

[52] U.S. Cl. ..... 277/1; 277/12; 277/186; 277/DIG. 10; 164/480

[58] Field of Search ..... 277/12, 1, 138, 277/181, 186, DIG. 10; 164/137, 425, 426, 445, 446, 483

[56] References Cited

U.S. PATENT DOCUMENTS

| | | | |
|---|---|---|---|
| 3,795,270 | 3/1974 | Fiala et al. | 164/483 |
| 3,799,238 | 3/1974 | Bruderer et al. . | |
| 4,178,000 | 12/1979 | Kuttner | 164/425 X |
| 4,332,289 | 6/1982 | Reithner et al. | 164/446 |
| 5,099,907 | 3/1992 | Dislich | 164/445 X |

FOREIGN PATENT DOCUMENTS

| | | | |
|---|---|---|---|
| 352924 | 10/1979 | Austria . | |
| 0114309 | 2/1987 | European Pat. Off. . | |
| 2811157 | 10/1978 | Germany . | |
| 285610 | 11/1993 | Japan | 164/483 |
| 801974 | 2/1981 | U.S.S.R. | 164/445 |
| 1348058 | 10/1987 | U.S.S.R. | 164/446 |
| 998652 | 7/1965 | United Kingdom | 164/426 |

*Primary Examiner*—Scott W. Cummings
*Attorney, Agent, or Firm*—Ostrolenk, Faber, Gerb & Soffen, LLP

[57] ABSTRACT

There is provided a seal for a starter bar head to be used in a continuous caster. The seal extends into a gap provided between the starter bar head and the side walls of a continuous casting mold under direct contact of the side faces of the starter bar head and of the mold side walls. In order to be able to produce this seal in a simple manner and to install it in a particularly quick manner, the seal is extended upwardly in the direction of the mold cavity at least as far as to the front face of the starter bar head and includes a cover part at least partially covering the front face of the starter bar head. The cover part is located to be free and uncovered relative to the mold cavity of the continuous casting mold and possibly introduced cooling scrap directly rests on the cover part of the seal.

22 Claims, 2 Drawing Sheets

METHOD OF SEALING AND SEAL FOR A STARTER BAR HEAD TO BE USED IN A CONTINUOUS CASTER

BACKGROUND OF THE INVENTION

1. Field of the Invention

The invention relates to a seal for a starer bar head to be used in a continuous caster, in particular in a continuous caster for casting steel strands having strip cross section or billet or bloom cross section, wherein the seal extends into a gap provided between the starer bar head and the side walls of a continuous casting mold under direct contact of the side faces of the starer bar head and of the mold side walls, as well as to various methods of obtaining tightness between a starter bar head and a continuous casting mold.

2. Description of the Related Art

At the beginning of continuous casting it is necessary to provide tightness between a so-called starter bar head, on which the cast strand is cast and by aid of which it is withdrawn from the mold, and the cavity of the mold, into which the metal melt is poured, in order to reliably prevent the penetration of metal melt. To this end, it is known to seal the starer bar head relative to the mold walls by means of sealing ropes, such as asbestos ropes. In former times, the attachment of such seals was effected from above, which was disadvantageous insofar as the accessiblity from above is limited, in particular with continuous casting molds having narrow cross sections, such as, for instance, for casting thin slabs and strands having strip cross section or billet or bloom cross section.

From AT-B-352,924 it is known to provide a starter bar head with a seal that is installable prior to introducing the starter bar head into the continuous casting mold and is usable several times, wherein the starer bar head has an encircling recess in which the seal is inserted. The seal is designed as a fiat seal, being supported by a spring leaf annularly extending on its rear.

From DE-A-28 11 157 seals of the initially described type are known, which are inserted in an encircling peripheral recess of the starter bar head, wherein, according to one embodiment, an elastic seal is designed like a hose and may be blown up by a gaseous medium. The seals known from that document likewise are attachable to the starter bar head prior to its introduction and are re-usable several times. However, difficulties may arise when introducing the starter bar head into the mold insofar as the seal located in the peripheral recess is completely cut off from visual inspection after the starter bar head has been introduced into the mold such that possible damage to the seal occurring during the procedure of introducing the starter bar head into the continuous casting mold cannot be recognized.

From EP-A-0 114 309 it is known to provide a starter bar head with a seal prior to its introduction into the mold, wherein a seal holder to be destroyed by the casting metal is put on the starter bar head and the seal is arranged between the starter bar head and the seal holder. According to a first embodiment, a peripherally extending encircling groove is formed between the seal holder and the starter bar head, in which the seal is inserted. With this embodiment, inspection of the seal after introduction of the starter bar head into the continuous casting mold is no longer possible.

According to another embodiment of EP-A-0 114 309, the seal is formed by a mat covered by a plate-shaped seal holder. Although this provides for a good protection to the seal during the procedure of introducing the starter bar head into the continuous casting mold, this variant—like that described above—is expensive, because, in addition to the seal, a separate seal holder must be produced and installed, which can be used only once, since it is destroyed by the casting metal flowing in.

SUMMARY OF THE INVENTION

The present invention overcomes these disadvantages and difficulties and by providing a seal for a starter bar head, which is produced at low expenditures, is attached in a simple and quick manner and which can be inspected to a certain degree after installation. Elements to be produced and installed in addition to the seal are avoided, in particular.

The method of attaching the seal provided by the invention is realized in a simple manner, i.e., to require only little manual operation. Furthermore, tightness is obtained within a particularly short span of time.

In accordance with an embodiment of the invention, the seal is extended upwardly in the direction of the mold cavity at least as far as to the front face of the starter bar head and comprises a cover part at least partially covering the front face of the starter bar head, wherein the cover part is located to be free and uncovered relative to the mold cavity of the continuous casting mold and possibly introduced cooling scrap directly rests on the cover part of the seal.

By the fact that the cover part at least partially covering the front face of the starter bar head is located to be free and uncovered relative to the mold cavity, easy optical inspection of the seal is feasible, since from an intact cover part covering the front face of the starter bar head an intact part of the seal covering the side faces of the starter bar head may be concluded.

According to a preferred embodiment, the seal is configured as a hat covering the starter bar head, which hat, however, may be provided with a recess on its part corresponding to the front face of the starter bar, for instance, in order to enable the passage of an anchoring element for the cast strand projecting from the front face of the starter bar head.

Suitably, the hat comprises an outwardly projecting rim or bead that gets into contact with the lower ends of the mold side faces and preferably is designed as a peripherally extending encircling bead. Thereby, it is possible to insert the seal into the starter bar in a precisely defined position prior to introducing it into the mold cavity.

According to a further preferred embodiment, the hat comprises an inwardly projecting rim or bead. This variant is particularly advantageous if the seal is applied to the starter bar head prior to introducing the same, wherein the rim or bead suitably is provided to correspond to an encircling recess of the starter bar head.

A preferred variant is characterized in that the cover part of the seal covering the front face of the starter bar head is designed to be curved upwards, i.e. towards the mold cavity.

To attain sufficient stability of the seal, the cover part of the seal covering the front face of the starter bar head suitably has a greater wall thickness than that part of the seal which extends into the gap provided between the starter bar head and the side walls of the continuous casting mold.

To ensure tightness without having to observe narrow tolerances when producing the seal, the wall thickness of the part of the seal extending into the gap provided between the starter bar head and the side walls of the continuous casting mold suitably is dimensioned to be larger than the width of this gap prior to introducing the starter bar head into the continuous casting mold.

A further preferred embodiment of the seal is characterized in that the seal is formed by a deformable mat or plate initially planar prior to installing the seal, whose area extension is dimensioned to be larger than the front face of the starter bar head, wherein, for the purpose of obtaining tightness in a simple manner, the thickness of the mat advantageously is dimensioned to be larger, preferably slightly larger, than the gap provided between the side walls of the continuous casting mold and the starter bar head.

With this embodiment, the seal suitably is fastenable to the starter bar head by means of an adhesive connection.

A method of sealing a continuous casting mold relative to a starter bar head, which requires only slight manual labor is characterized in that a seal at least partially covering the side faces of the starter bar head and the front face of the starter bar head is inserted into the mold cavity of the continuous casting mold from below, wherein a rim or annular bead directed outwards on the lower edge of the seal gets to abut on the lower edge of the continuous casting mold, whereupon the starter bar head is inserted into the continuous casting mold at least until its front face abuts on the cover part of the seal corresponding to the front face.

In doing so, the starter bar head suitably is inserted into the mold cavity by the above-defined minimum measure, while carrying with it the seal and tearing off the outwardly projecting rim or annular bead or deforming the same.

A further advantageous method of sealing a continuous casting mold relative to a starter bar head to be carried out within a particularly short span of time is characterized in that a hat-shaped seal at least partially covering the side walls of a starter bar head and the front face of the starter bar head is put on the starter bar head under automatic clamping prior to introducing the starter bar head into the mold cavity of the continuous casting mold and that the starter bar head subsequently is introduced into the continuous casting mold from below.

A method of sealing a continuous casting mold relative to a starter bar head, for which a seal that is particularly simple to produce will suffice, is characterized in that a seal designed as an initially planar mat or plate, whose area extension is dimensioned to be larger than the front face of the starter bar head, is adhered to the front face of the starter bar head and the starter bar head subsequently is inserted into the continuous casting mold under deformation of the edge regions of the seal projecting beyond said front face prior to introducing the starter bar head into the continuous casting mold.

Particularly good sealing of the gap may be obtained if, during the introduction of the starter bar head into the continuous casting mold, the seal is deformed while being clamped between the side faces of the starter bar head and the side walls of the continuous casting mold.

BRIEF DESCRIPTION OF THE DRAWINGS

In the following, the invention will be explained in more detail by way of several exemplary embodiments and with reference to the figures illustrated in the drawing, wherein.

DESCRIPTION OF THE PREFERRED EMBODIMENTS

Figure 1:
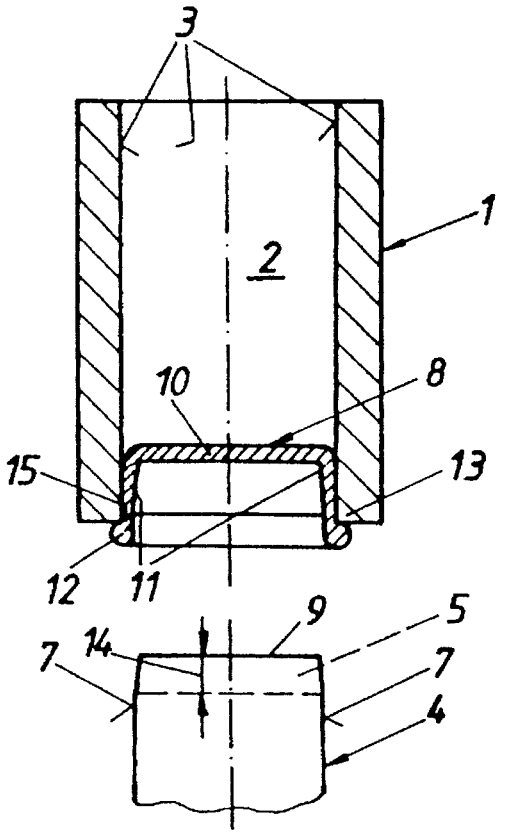
FIG. 1 is a schematic illustration of a continuous casting mold in the longitudinal section prior to introduction of the starter bar into the same.

In FIG. 1 a continuous casting mold 1 is shown in the longitudinal section in schematic illustration. This continuous casting mold is destined for casting a steel strand having billet or bloom cross section.

For casting-on, the lower end of the mold cavity 2 delimited by the side walls 3 of the continuous casting mold 1 is closed by a starter bar head 4. The starter bar head 4 has a cross-sectional dimension that is slightly smaller than the cross section of the mold cavity 2 such that the mold side walls 3 will not get damaged during the introduction of the starter bar head into the mold cavity on account of the resulting play. The starter bar head 4, on its front face, has a cast-on opening 5 provided with undercuts 6, which is filled with molten steel at the beginning of casting. In this manner, a connection to the cast strand is created, which transmits the withdrawal forces sufficiently well.

In order to prevent metal melt, in the instant case molten steel, from flowing out or penetrating through the gap provided between the mold side walls 3 and the side faces 7 of the starter bar head, a seal 8 is provided, which, according to the embodiment illustrated in FIG. 1, is formed like a hat. The seal 8 comprises a cover part 10 corresponding to the front face 9 of the starter bar head, from which side parts 11 extend downwards parallel to the side walls 3 of the continuous casting mold 1. The side parts 11, which form a closed wall, on their lower ends are provided with a peripheral encircling bead 12 substantially extending peripherally outwards.

The external cross section of the seal 8 is dimensioned to be slightly larger than the cross section of the mold cavity 2 such that the seal is introducible into the mold cavity 2 from below without play and under slight clamping until the bead 12 appears on the lower ends 13 of the side walls 3 of the continuous casting mold 1. The internal cross section of the seal 8, in turn, is dimensioned to be slightly smaller than the external cross section of the starter bar head 4 such that the side parts 11 of the seal 8 will be deformed, even slightly though, during the subsequent introduction of the starter bar head 4, thereby reliably preventing the formation of a gap between the side faces 7 of the starter bar head 4 and the side walls 3 of the continuous casting mold 1.

The cover part 10 of the seal 8 covering the front face 9 of the starter bar head has a greater wall thickness than the side parts 11 of the seal 8. This cover part 10 also may include an opening such that molten steel can reliably enter the anchoring recess 5 of the starter bar head 4, thus forming a reliable anchorage.

According to the exemplary embodiment illustrated in FIG. 1, the side parts 11 of the seal 8, in terms of height, extend over a distance that is larger than the depth 14 of the anchoring recess 5 such that the anchoring recess 5 likewise is reliably sealed and molten steel cannot escape through the same.

The peripheral bead 12 provides a limit for the insertion of the seal 8 occurring prior to introducing the starter bar head 4 into the continuous casting mold 1 and, at the same time, reliably enables inspection of the snug fit of the seal 8.

When introducing the starter bar head 4 into the continuous casting mold 1, the starter bar head 4 is threaded in until it contacts the cover part 10 of the seal 8, whereupon it is moved upwards a little bit further, thus possibly causing the bead 12 to be torn off the side parts 11 of the seal.

It may be suitable to provide a narrow section 15 on the side parts 11 of the seal 8 just above the bead 12 in order to pre-fix the site of separation of the bead 12 from the side parts 11 of the seal 8. Thereby, uncontrolled tears in the side parts 11 are reliably prevented.

The insertion of the seal 8 into the continuous casting mold 1 from below is particularly advantageous primarily with billet or bloom casters, since there it can be accomplished in a simple manner.

Continuous casters for billets or blooms mostly are designed in a manner that the lower side of the continuous casting mold 1 is readily accessible from the rear side of the continuous caster. With multiple-strand casters, the strand guides of neighboring strands, in the region of the continuous casting mold 1 and closely below the mold, are structurally separated in a manner that such manipulation can be carried out without any danger even if casting takes place in adjacent continuous casting molds.

Figure 2:
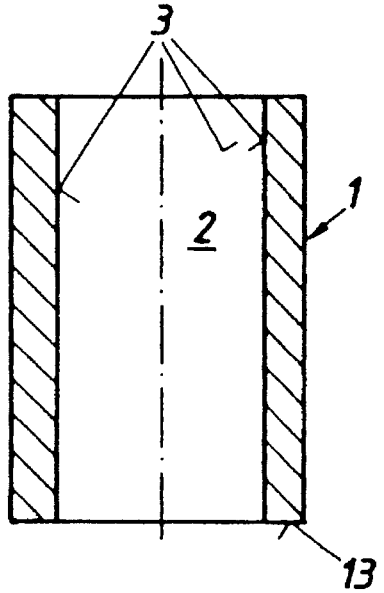
FIG. 2 represents a second embodiment of a seal in an illustration analogous to FIG. 1.
Figure 2:
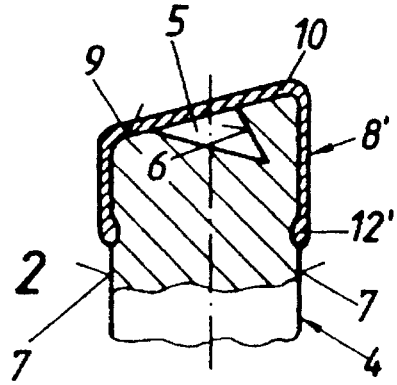
Figure 3:
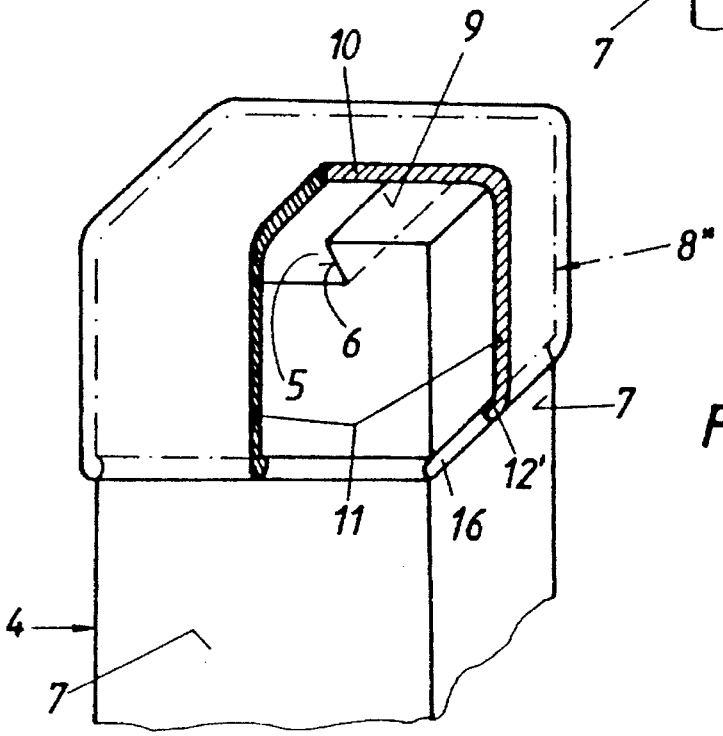
FIG. 3 is a partially sectioned diagonal view of an embodiment of a seal put on a starter bar head.

According to the embodiments illustrated in FIGS. 2 and 3, the seal 8', 8" is put on the starter bar head 4 prior to starting the introduction of the starter bar head 4 into the continuous casting mold. In this case, it is held by clamping or by providing an inwardly projecting encircling bead 12' that snaps into a peripherally encircling groove 16 of the starter bar head 4. In doing so, it is essential that the seal 8 rests on the starter bar head 4 sufficiently firmly and does not slide down as the starter bar head 4 is conveyed along the strand guide as far as to the continuous casting mold 1.

The external cross section of the seal 8 put on the starter bar head 4 in this case is dimensioned to be slightly larger than the internal cross section of the mold cavity 2 such that absolute tightness can be obtained also in this case under slight deformation of the side parts 11 of the seal 8.

Figure 4:
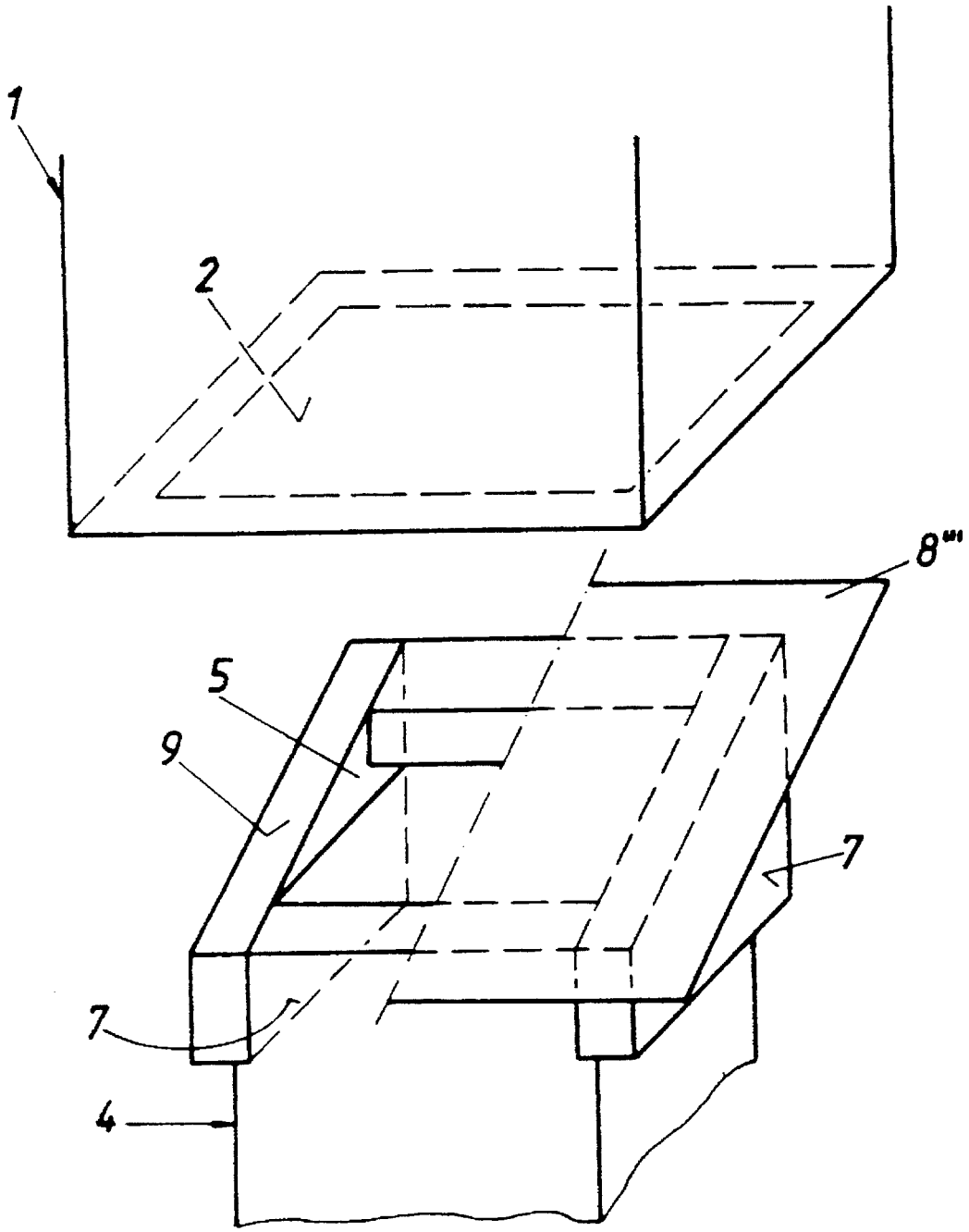
FIG. 4 also is a diagonal view of a further embodiment of a seal arranged on a starter bar head prior to introduction of the starter bar head into the continuous casting mold.

According to the embodiment illustrated in FIG. 4, the seal 8''' is designed as a mat or plate, whose area extension is dimensioned to be larger than the front face 9 of the starter bar head 4. This mat or plate 8''' preferably is adhered to the front face of the starter bar head 4, yet fastening also might be effected by means of putty. It would also be feasible to use a sealing mat to whose rear side an adhesive layer is applied.

When introducing the starter bar head 4 into the mold cavity 2, the parts of the plate or mat projecting beyond the front face 9 of the starter bar head are laid down, thus forming side parts of the seal 8''' reliably sealing the gap provided between the side walls 3 of the continuous casting mold 1 and the side faces 7 of the starter bar head 4. Tearing of the plate-shaped or mat-like seal advantageously may be prevented by designing the starter bar 4 to be well rounded off on the edges where the front face 9 merges into the side faces 7.

Putting a seal 8', 8", 8''' configured according to FIG. 2, 3 or 4, respectively, on, or adhering it to, the starter bar head 4 may be effected outside of the continuous caster or also in a zone of the strand guide during running up of the starter bar head 4 in the direction towards the continuous casting mold 1 by interrupting this running up at a point suitable for readily carrying out the required manipulations. After having introduced the starter bar head 4 into the continuous casting mold 1, the seal 8, 8', 8", 8''' according to all of the embodiments lies completely free in the direction towards the mold cavity 2 and, when looking from above into the continuous casting mold 1, it is immediately apparent whether the cover part 10 of the seal covering the front face 9 of the starter bar head 4 has been damaged or not. If it has not been damaged, this is an indication that the side parts 11 of the seal 8 to 8''' have not been damaged, either.

After having introduced the starter bar head 4 into the continuous casting mold 1 and having checked the seal 8 to 8''', cooling scrap (iron chips) is top-charged at a pile of some centimeters, preferably 5 to 10 cm, in height, whereupon the casting in of molten steel can be started. The purpose of the seal then will be to seal the gap provided between the side walls 3 of the continuous casting mold 1 and the side faces 7 of the starter bar head 4 during a short span of time after casting-on, which is needed by the molten steel to solidify. Suitable materials for the seals 8 to 8''' comprise synthetic materials (injection molded pans), felts (pressed parts), impregnated paper and the like.

The seal according to the invention, in principal, may be provided for all kinds of starter bar heads 4, even for starter bar heads including anchoring projections. In this case, the anchoring projection suitably projects through an opening provided in the cover part 10 covering the front side 9 of the starter bar head 4. However, the seal also could be designed so as to enclose the anchoring projection, the latter being laid free only by casting-on, during which procedure the seal is damaged in this region. The seal according to the invention is suitable for any strand cross section whatsoever, with particular advantage for continuous casting molds having cavities that are difficult to accede, such as molds for strips and molds for billets or blooms.

What we claim is:

1. A sealing means for a starter bar head having a front face and side faces, to be used in a continuous casting plant, the casting plant including a continuous casting mold with mold side walls having lower ends and defining a mold cavity and a gap provided between said mold side walls and said side faces of said starter bar head, said sealing means comprising:

side parts extending into said gap under direct contact with said side faces of said starter bar head and said mold side walls; and a heat resistant cover part connected with said side parts and at least partially covering said front face of said starter bar head, said cover part being located, when inserted into said casting mold with said starter bar head, to be free and uncovered relative to said mold cavity of said continuous casting mold prior to introduction of steel into said casting mold.

2. A sealing means as set forth in claim 1, wherein said cover part is provided to hold cooling scrap charged into said mold cavity so as to directly rest on said cover part of said sealing means.

3. A sealing means as set forth in claim 1, wherein said sealing means is configured as a hat covering said started bar head.

4. A sealing means as set forth in claim 3, wherein said side parts have an edge region, and said hat comprises and outwardly projecting rim or bead extending from said edge region for contacting said lower ends of said mold side walls.

5. A sealing means as set forth in claim 4, wherein said mold side walls form a cross-sectional shape and said rim or bead is designed as a peripherally extending encircling bead having a shape corresponding to said cross-sectional shape.

6. A sealing means as set forth in claim 4, wherein said hat comprises an inwardly projecting rim or annular bead.

7. A sealing means as set forth in claim 5, further comprising a tear-off, narrow section provided between said rim or annular bead and said side parts of said sealing means for pre-fixing a site of separation of said rim or bead from said side parts.

8. A sealing means as set forth in claim 5, wherein an encircling recess is provided in said starter bar head and said rim or bead is provided so as to correspond with said encircling recess.

9. A sealing means as set forth in claim 1, wherein said cover part of said sealing means covering said front face of said starter bar head is curved towards said mold cavity.

10. A sealing means as set forth in claim 1, wherein said sealing means, in addition to said cover part covering said front face of said starter bar head, has a seal part extending into said gap provided between said starter bar head and said side walls of said continuous casting mold and having a seal part wall thickness, said cover part of said sealing means having a cover part wall thickness that is larger than said seal part wall thickness.

11. A sealing means as set forth in claim 10, wherein said gap has a gap width, and said seal part wall thickness of said seal part extending into said gap provided between said starter bar head and said side walls of said continuous casting mold is dimensioned to be larger than said gap width prior to introducing said starter bar head into said continuous casting mold.

12. A sealing means as set forth in claim 1, wherein said sealing means has external dimensions, and at least some of said dimensions are larger than the internal cross-sectional dimensions of said mold cavity.

13. A sealing means as set forth in claim 1, wherein said sealing means is provided in the form of a deformable mat or plate initially, said side parts and said cover part being substantially co-planar prior to installing said sealing means, said mat having an area extension dimensioned to be larger than said front face of said starter bar head.

14. A sealing means as set forth in claim 13, wherein said mat or plate has a mat or plate thickness dimensioned to be larger than said gap provided between said side walls of said continuous casting mold and said starter bar head.

15. A sealing means as set forth in claim 14, wherein said mat or plate thickness is dimensioned to be slightly larger than said gap provided between said side walls of said continuous casting mold and said starter bar head.

16. A sealing means as set forth in claim 14, wherein said sealing means is fastenable to said starter bar head by an adhesive.

17. A method of sealing a continuous casting mold, including mold side walls defining a mold cavity and a lower edge, relative to a starter bar head having a front face and side faces, which method comprises the steps of:

inserting a sealing means including a cover part for at least partially covering said front face of said starter bar head, having an outwardly projecting rim or bead provided peripherally around a lower edge of said sealing means, and for at least partially covering said side faces of said starter bar head, into said mold cavity of said continuous casting mold from below such that said outwardly projecting rim or annular bead abuts said lower edge of said continuous casting mold; and inserting said starter bar head into said continuous casting mold at least until its front face abuts said cover part of said sealing means.

18. A method as set forth in claim 17, wherein said starter bar head is inserted into said mold cavity at least until its front face abuts said cover part of said sealing means corresponding to said front face, while carrying with it said sealing means and tearing off said outwardly projecting rim or bead.

19. A method as set forth in claim 17, wherein said starter bar head is inserted into said mold cavity at least until its front face abuts said cover part of said sealing means corresponding to said front face, while carrying with it said sealing means and deforming said outwardly projecting rim or bead.

20. A method of sealing a continuous casting mold, including mold side walls defining a mold cavity, relative to a starter bar head having a front face and side faces, which method comprises the steps of:

putting a heat resistant hat-shaped sealing means on said starter bar head under automatic clamping prior to introducing said starter bar head into said mold cavity of said continuous casting mold, said hat-shaped sealing means at least partially covering said side faces of said starter bar head and said front face of said starter bar head;

inserting said starter bar head into said continuous casting mold from below; and locating said cover part, when inserted into said casting mold with said starter bar head, to be free and uncovered relative to said mold cavity of said continuous casting mold prior to introduction of steel into said casting mold.

21. A method of sealing a continuous casting mold, including mold side walls defining a mold cavity, relative to a starter bar head having a front face and side faces, which method comprises the steps of:

adhering to said front face of said starter bar head a heat resistant sealing means in the form of an initially plane mat or plate and having an extend area dimensioned to be larger than said front face of said starter bar head so as to provide for a cover part and seal rim regions projecting beyond said front face prior to introducing said starter bar head into said continuous casting mold;

inserting said starter bar head into said continuous casting mold while deforming said seal rim regions projecting beyond said front face, and;

locating said cover part, when inserted into said casting mold with said starter bar head, to be free and uncovered relative to said mold cavity of said continuous casting mold prior to introduction of steel into said casting mold.

22. A method as set forth in claim 20, wherein said sealing means, during insertion of said starter bar head into said continuous casting mold, is deformed under clamping between said side faces of said starter bar head and said side walls of said continuous casting mold.

* * * * *